United States Patent [19]

La Pointe

[11] 4,334,520

[45] Jun. 15, 1982

[54] ACCESSORY FOR FIREPLACE DAMPER

[76] Inventor: Henry A. La Pointe, 111 Almaden Blvd., San Jose, Calif. 95198

[21] Appl. No.: 176,475

[22] Filed: Aug. 8, 1980

[51] Int. Cl.[3] ..... F23L 13/02

[52] U.S. Cl. ..... 126/288

[58] Field of Search ..... 126/288, 295, 286, 287; 81/177 A; 403/312, 306, 393, 388; 294/9, 13, 53.5; 16/110 R, 110.5, 112, 114 R, 115, 124

[56] References Cited

U.S. PATENT DOCUMENTS

| | | | |
|---|---|---|---|
| 1,224,516 | 5/1917 | Tyler | 126/288 |
| 1,415,522 | 5/1922 | Cain | 126/288 |
| 1,631,123 | 6/1927 | Guy | 126/288 |
| 1,657,369 | 1/1928 | Chapman | 126/288 |
| 3,773,029 | 11/1973 | Kent | 126/288 |
| 4,015,587 | 4/1977 | Wincek | 126/288 |
| 4,265,217 | 5/1981 | Flaherty et al. | 126/288 |
| 4,305,377 | 12/1981 | Shull | 126/288 |

FOREIGN PATENT DOCUMENTS

| | | | |
|---|---|---|---|
| 154023 | 3/1938 | Fed. Rep. of Germany | 403/393 |

*Primary Examiner*—James C. Yeung

*Attorney, Agent, or Firm*—Jack M. Wiseman; Francis W. Anderson

[57] ABSTRACT

An accessory for a fireplace damper comprising a handle. Integrally formed with the handle is an intermediate member. At the opposite end of the intermediate member are mounted oppositely directed U-shaped clamps for gripping the handle or actuating member of a fireplace damper. The clamps engage the damper handle of a fireplace in gripping relation. The accessory projects toward the fireplace opening below the lintel. The accessory is visible and accessible to an operator. An operator desiring to open or close the fireplace damper grips the handle of the accessory for applying a downward or upward force thereto.

9 Claims, 5 Drawing Figures

ACCESSORY FOR FIREPLACE DAMPER

BACKGROUND OF THE INVENTION

The present invention relates in general to fireplace dampers, and more particularly to a fireplace damper having a manually actuable extension.

The U.S. Pat. to Kent, No. 3,773,029, issued on Nov. 20, 1973, for Front Operated Fireplace Damper Control discloses a connector arm that is attached to a lever of a fireplace arm by a nut and bolt. The free end of the connector arm includes a handle. The distance the handle projects toward the fireplace opening is adjustable by selecting the opening at its proximal end to register with the opening in the damper lever for the nut and bolt securement therebetween.

In the U.S. Pat. to Billmeyer, No. 4,117,827, issued on Oct. 3, 1978, for a Fireplace Construction, there is disclosed a rotatably disc damper within a housing surrounding a firebox of a prebuilt fireplace. The disc damper is controlled externally of the firebox by a rotatably shaft extending forwardly through the housing. The shaft is engaged by an external actuator operated from the front of the fireplace.

The U.S. Pat. to Ammons, No. 3,908,633, issued on Sept. 30, 1975, for Fireplace Damper Actuating Tool discloses a tool to actuate the lever of the fireplace damper. The tool includes a foot insertable in the hole of the damper lever. The tool also includes a handle to open and close the damper by actuating the damper lever.

In the U.S. Pat. to Walters, No. 3,821,924, issued on July 2, 1974, for Damper Mechanism For Kitchen Ventilating Systems, there is disclosed a damper mechanism for kitchen ventilators. The damper mechanism includes a damper door journalled for movement between an opened and closed position within the ventilator system. The damper door is spring loaded toward its closed position. A handle and a retractable bar opens the damper door.

As for the U.S. Pat. to Boldt, No. 1,928,165, issued on Sept. 26, 1933, for Combined Fireplace Throat And Damper, it discloses a damper with a downwardly extending arm to which is pivotally secured an actuating arm and a chain. A handle connected to the chains opens and closes the damper.

SUMMARY OF THE INVENTION

An accessory for a fireplace damper which includes at one end a handle and at the other end U-shaped clamps. The U-shaped clamps are secured to the handle of a fireplace damper. The operator desiring to open or close the fireplace damper grips the handle of the accessory for applying a downward or upward force thereto.

A feature of the present invention is the adjustable length of the intermediate member of the accessory which is integrally formed with the handle and the attachment member on which the U-shaped clamps are mounted.

The accessory projects toward the fireplace opening below the lintel when installed on the handle of the damper. The accessory, therefore, is visible and accessible to an operator.

An object of the present invention is to provide an improved arrangement for securing a damper accessory to the damper handle.

An another object of the present invention is to provide a damper accessory with an adjustable length.

Another feature of the present invention is the articulated arrangement of the linkage of the damper accessory in which the handle is pivotal to various locations corresponding to the movement of the fireplace damper. When the fireplace damper is in the closed position, the handle pivots into the fireplace centrally thereof to warn an operator that the fireplace damper is closed. Conversely, when the fireplace is not in use, the location serves as a reminder to an operator that the damper is in the opened position and should be closed to conserve heat and energy. Open dampers enable heat to escape from a building, resulting in a loss of heat and expenditure of energy. In a similar manner, where air conditioning is available, there is a conservation of energy.

DESCRIPTION OF A PREFERRED EMBODIMENT

Figure 1:
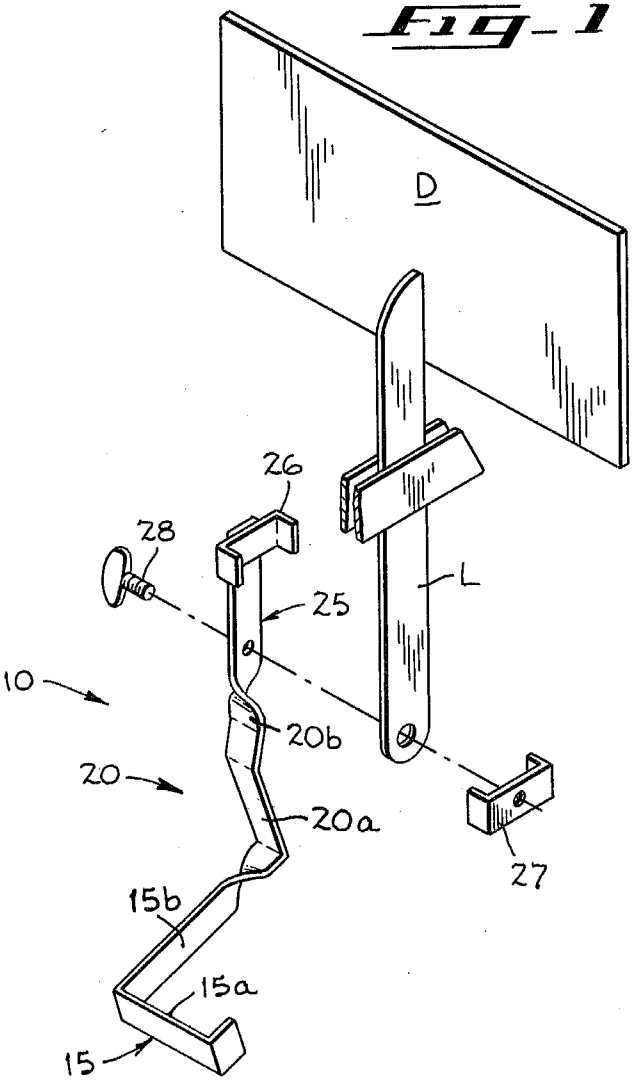
FIG. 1 is an isometric, exploded view of an accessory for a fireplace damper embodying the present invention illustrated with a fireplace damper.
Figure 2:
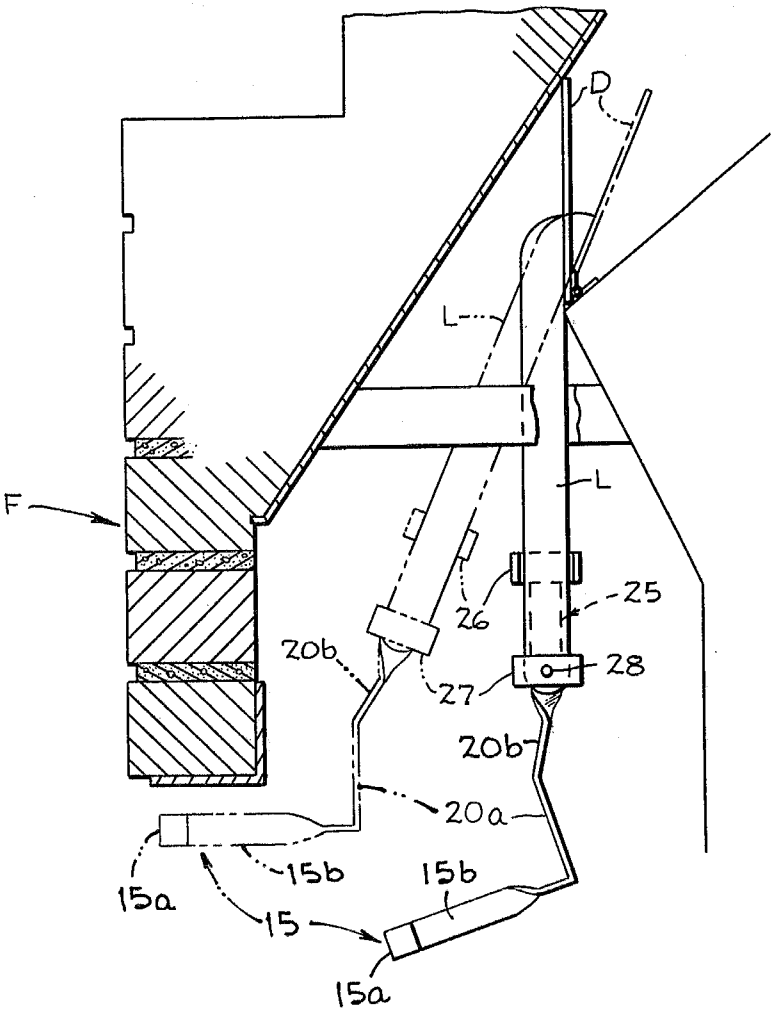
FIG. 2 is a side elevation of the accessory for a fireplace damper shown in FIG. 1 illustrated in a section of a fireplace with a fireplace damper.

Illustrated in FIGS. 1 and 2 is an accessory 10 for a fireplace damper D embodying the present invention. The accessory 10 for the fireplace damper D comprises a handle 15 made of suitable rigid, non-combustible material, such as iron or steel. For facilitating the gripping thereof by an operator, the handle 15 includes a forwardly directed section 15*a* disposed at right angles to a rearwardly direction section 15*b*.

Integrally formed with the handle 15 at the end thereof opposite from the forwardly extending section 15*a* is an intermediate member 20. The intermediate member 20 is made of the same material as is the handle 15. The intermediate member 20 extends forwardly from the handle 15 and includes a forwardly direction section 20*a* joining the handle 15 at right angles thereto and a forwardly and downwardly extending section 20*b* that extends from the section 20*a* at right angles thereto. The sections 20*a* and 20*b* are substantially at right angles to one another and the section 20*a* is generally parallel to the section 15*a* of the handle 15. The junction between the sections 20*a* and 20*b* is turned so that the surfaces of the sections 20*a* and 20*b* defining the widths thereof are mutually perpendicular.

Integrally formed with the intermediate member 20 and extending forwardly therefrom is a lever attachment member 25 for the accessory 10. The attachment member 25 is made of the same material as the intermediate member 20. Mounted on the same side of the attachment member 25 are oppositely directed U-shaped clamps 26 and 27. The U-shaped clamp 26 is fixedly secured to the attachment member 25 through a rivet or the like and the U-shaped clamp 27 is detachably secured to the attachment member 25 through a screw 28. The junction between the section 20*b* of the intermediate member 20 and the attachment member 25 is turned so that the surfaces of the attachment 25 defining the width thereof is generally upright for establishing parallelism with the surface of the handle L of the fireplace damper D.

In operation, the clamp 27 is loosened relative to the attachment member 25. The handle L of the actuating member or fireplace damper D (FIG. 1) is received at its forward end by the clamp 26. Thereupon, the clamp 27 is drawn by the screw 28 toward the attachment member 25 to receive the rearward end of the handle L in clamping engagement. The handle L generally includes an opening at the free end thereof which is received by the screw 28 when the clamp 27 is drawn by the screw 28 toward the attachment member 25 for the clamping engagement with the handle L.

The oppositely directed clamps 26 and 27 and the attachment member 25 detachably secure the accessory 10 to the handle L.

Figure 3:
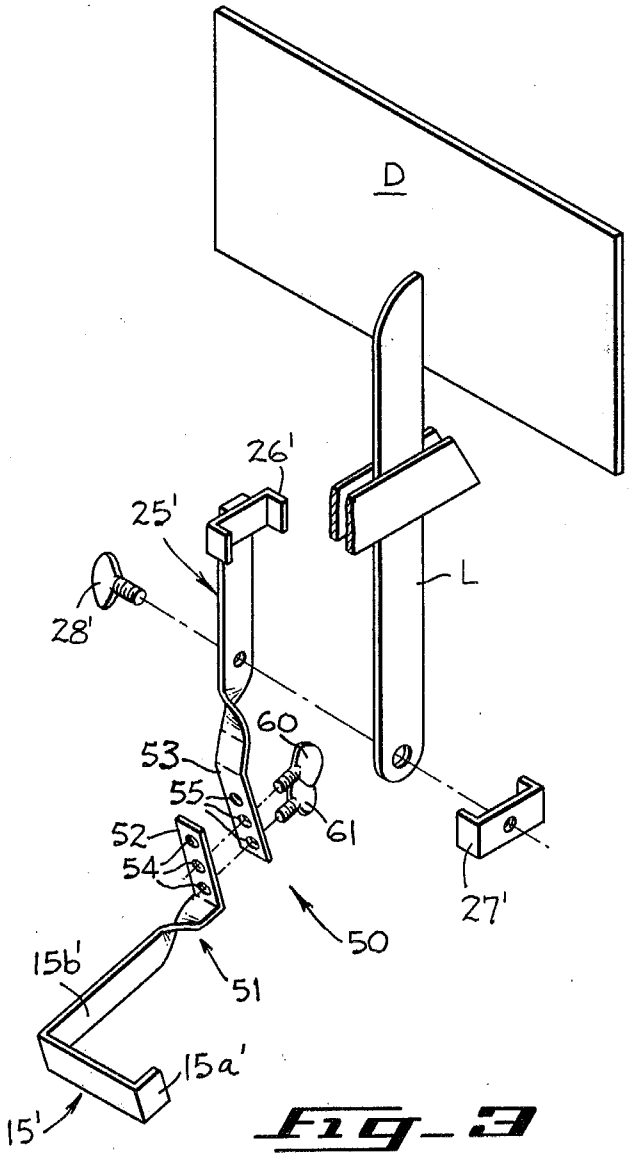
FIG. 3 is an isometric, exploded view of an accessory for a fireplace damper which is a modification of the accessory for a fireplace damper shown in FIGS. 1 and 2 and illustrated with a fireplace damper.
Figure 4:
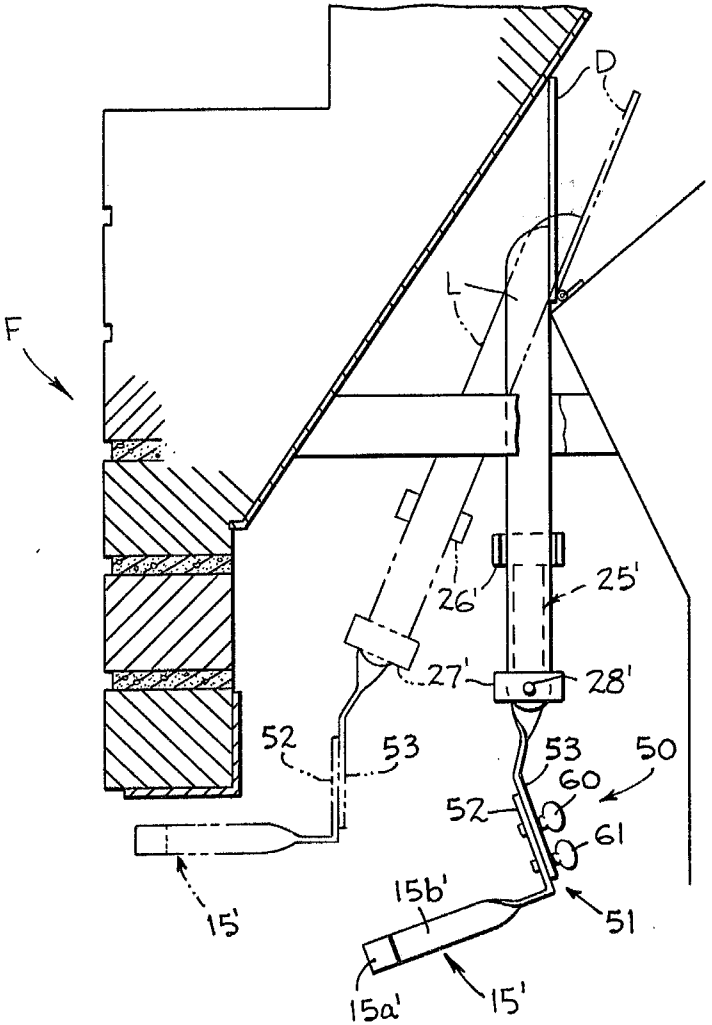
FIG. 4 is a side elevation view of the accessory for a fireplace damper shown in FIG. 4 illustrated in a section of a fireplace with a fireplace damper.

Illustrated in FIGS. 3 and 4 is an accessory 50 for a fireplace damper, which is a modification of the accessory 10 shown in FIGS. 1 and 2. Those parts of the accessory 50 which are similar to the parts of the accessory 10 are designated with the same reference numeral with the addition of a prime suffix.

The accessory 50 differs from the accessory 10 in that the length thereof is adjustable. Toward this end, the intermediate section 51 comprises juxtaposed straps 52 and 53 disposed in parallel relation. Suitable openings 54 are formed in the strap 52 in longitudinally spaced relation. Suitable openings 55 are formed in the strap 53. The openings 55 are disposed in alignment with selected openings 54 for adjusting the length of the intermediate section 51. When the openings 55 and the selected openings 54 register, bolts 60 and 61 are inserted in the registered openings. The nuts are threaded on the bolts for securing the straps 52 and 53 together.

When the damper D is closed, the handle 15 is located in the opening of the fireplace F so as to be readily visible to a person in front of the fireplace F. This condition serves as a warning to an operator not to light the fireplace, because the damper D is closed. When the damper D is opened, the handle 15 is in the fireplace opening immediately below the lintel of the fireplace F. When the fireplace F is not in use and the handle 15 is immediately below the lintel, an operator is reminded to close the damper D. The closing of the damper D reduces heat and cooling losses and therefore serves to conserve energy.

Figure 5:
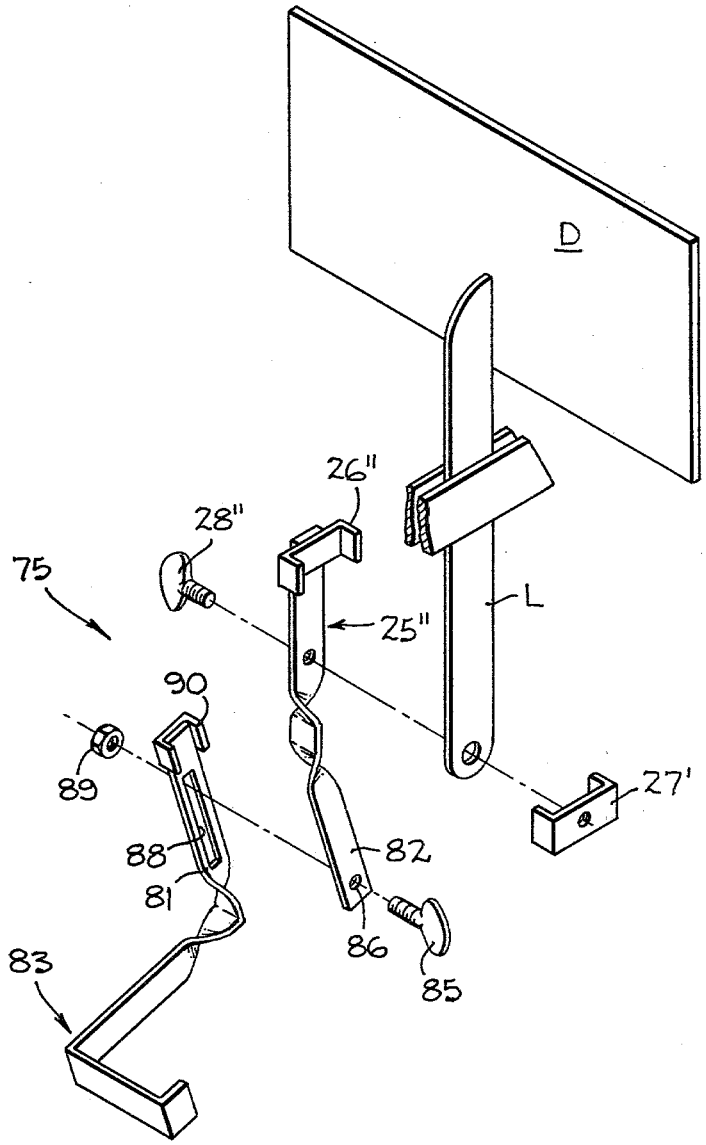
FIG. 5 is an isometric view of an accessory for a fireplace damper which is a modification of the accessory for a fireplace damper shown in FIGS. 3 and 4.

Illustrated in FIG. 5 is an accessory 75 for a fireplace damper, which is a modification of the accessory 50 shown in FIGS. 3 and 4. Those parts of the accessory 75 which are similar to the parts of the accessory 50 are designated with the same reference numeral with the addition of a double prime.

The accessory 75 differs from the accessory 50 in that the juxtaposed members 81 and 82 of an intermediate section 83 are adjustably secured for regulating the length of the accessory 75 by a bolt fixedly disposed on one of the juxtaposed members and adjustably movable in an elongated slot formed in the other of the juxtaposed members.

More specifically, a bolt 85 is received by an opening 86 in the member 82 for rotation therein. Formed in the member 81 is an elongated slot 88 that also receives the bolt 85. A nut 89, when tightened on the bolt 85, detachably secures the juxtaposed members 81 and 82 together. When the nut 89 is loosened the bolt 85 is movable in the slot 88 to adjust the effective length of the accessory 75.

Fixed to the member 81 is a U-shaped stop 90 that retains the member 82 in position along the member 81. The legs of the U-shaped stop 90 engage the sides of the member 82 to limit any excessive pivotal movement thereof relative to the member 81.

I claim:

1. An accessory for a fireplace damper having an actuating member connected thereto comprising an accessory handle, an intermediate member connected to and projecting away from said handle, an attachment member connected to said intermediate member and forming an extension thereof, a pair of clamp members mounted on said attachment member in spaced relation for gripping the actuating member of the fireplace damper at spaced points, whereby the movement of said accessory handle controls the opening and closing of the damper.

2. An accessory as claimed in claim 1 wherein each of said clamps is a U-shaped clamp.

3. An accessory as claimed in claim 2 wherein said U-shaped clamps are oppositely directed.

4. An accessory as claimed in claim 3 wherein said clamps are disposed on the same side of said attachment member.

5. An accessory as claimed in claim 3 wherein said intermediate member includes juxtaposed means adjustably secured together to vary length of said intermediate member for regulating the length of said accessory.

6. An accessory as claimed in claim 5 wherein each of said juxtaposed means is formed with spaced openings therealong, the registry of openings therebetween adjusts the length of said intermediate member, said intermediate member including securing means received by registered openings for securing said juxtaposed means together.

7. An accessory as claimed in claim 5 wherein one of said juxtaposed means is formed with an elongated slot therealong, said accessory comprising securing means disposed on the other of said juxtaposed means and movable within said elongated slot to adjust the length of said intermediate member for regulating the length of said accessory, said securing means being arranged to secure said juxtaposed means together in the adjusted position.

8. An accessory as claimed in claim 3 wherein said intermediate member includes means for adjusting the length to regulate the length of said accessory.

9. An accessory for a fireplace damper having an actuating handle connected thereto comprising an accessory handle, an intermediate member connected to said accesory handle and projecting forwardly therefrom, an attachment member connected to said intermediate member and projecting forwardly therefrom, a pair of U-shaped clamping members mounted on said attachment member in oppositely-facing directions and arranged to clamp the damper handle to said attachment member, said intermediate member including juxtaposed means, one of said juxtaposed means having an elongate slot, securement means extending through said slot and adapted to lock said juxtaposed means together in selected adjusted positions, and a U-shaped stop on said one juxtaposed means for retaining said other juxtaposed means in position along said one juxtaposed means.

* * * * *